US007337546B2

(12) United States Patent
Cheng

(10) Patent No.: US 7,337,546 B2
(45) Date of Patent: Mar. 4, 2008

(54) FOLDABLE KNIFE

(76) Inventor: Xiaoxia Cheng, 1176 Wangfu Street, Jindong District, Jinhua Shi, Zhejiang Province 321015 (CN)

( * ) Notice: Subject to any disclaimer, the term of this patent is extended or adjusted under 35 U.S.C. 154(b) by 0 days.

(21) Appl. No.: 11/484,904

(22) Filed: Jul. 12, 2006

(65) Prior Publication Data

US 2007/0011881 A1 Jan. 18, 2007

(30) Foreign Application Priority Data

Jul. 14, 2005 (CN) ..... 2005 2 0013330

(51) Int. Cl.
*B26B 1/02* (2006.01)

(52) U.S. Cl. ..... 30/156; 30/330

(58) Field of Classification Search ..... 30/155, 30/156, 157, 329, 330, 331, 339; 3/156, 3/330

See application file for complete search history.

(56) References Cited

U.S. PATENT DOCUMENTS 515,045 A * 2/1894 Bultzingslowen ..... 279/77
2,134,973 A * 11/1938 Harwell ..... 30/156
5,095,624 A * 3/1992 Ennis ..... 30/161
6,915,577 B2 * 7/2005 Scala ..... 30/156
2003/0037444 A1 * 2/2003 Chunn ..... 30/337
2005/0055833 A1 * 3/2005 Scarla ..... 30/156
2005/0204567 A1 9/2005 Ping ..... 30/161

FOREIGN PATENT DOCUMENTS

CN 200420008854.6 * 3/2004

* cited by examiner

*Primary Examiner*—Hwei-Siu C. Payer
(74) *Attorney, Agent, or Firm*—Ware, Fressola, Van Der Sluys & Adolphson

(57) ABSTRACT

A foldable knife, comprising a blade, a knife head and a handle. The knife head has a movable part which can be pushed to press on a locking part. The locking part has two ends, one end is rotably fastened by a bolt to the knife head and another, a free end, has a catch. The blade has a notch on an edge opposite to a cutting edge. The catch corresponds to the notch. The blade may have two or more notches. The handle may be hollow and knife head is rotably fastened on the handle by a bolt. The knife head and the blade can be rotably folded at least partially into the handle.

4 Claims, 1 Drawing Sheet

FOLDABLE KNIFE

CROSS REFERENCE TO RELATED APPLICATIONS

This application claims priority from a Chinese Patent Application No. 200520013330.0, filed on Jul. 14, 2005.

FIELD OF THE INVENTION

The present invention relates generally to hand tools.

DESCRIPTION OF THE BACKGROUND

A utility knife is a tool for cutting hard materials such as leather, rubber, etc. It comprises a changeable knife blade and a knife body. Among the utility knives currently on the market, there are two main types of mechanisms for holding the knife blade onto the knife body. One type is bolt fastening. Another type is laterally pressuring. These two types of mechanisms have common problems of inconvenient to install the blade and difficult to tighten the blade. For the bolt fastening type, changing the knife blade is inconvenient, and a gap between the bolt and the blade would make the blade slightly movable, therefore affecting the precision of the cutting. Meanwhile, the size of the bolt cannot be too small. For the laterally pressuring type (i.e. the blade is installed by opening one side panel of a two-panel body, placing the blade inside, and closing the side panel using a U-shaped clamp to hold the two panels and blade together), has the problem of using only one edge of the body panels for applying the pressure to secure the blade. The pressure to secure the blade, coming from the U-shaped clamp, may not be strong enough, and the pressure is conducted by the body panels to the blade, not directly applied on the blade. When in operation, a force applied on the object being cut generates a reacting force on the knife. This reacting force may affect the stability of the blade.

DISCLOSURE OF THE INVENTION

The present invention is designed to overcome the above limitations that are attendant upon the use of "prior art" utility knives, and toward this end, it contemplates the provision of a novel design for a foldable utility knife. The foldable utility knife of the present invention has the advantages of high stability in locking the blade, easy to change the blade, and structurally simple and sound.

The foldable knife of the present invention comprises a blade, a knife head and a handle, characterized in that the knife head has a movable part which can be pushed to press on a locking part; the locking part has two ends, one end is rotably fastened by a bolt to the knife head and another, a free end, has a catch; the blade has a notch on the edge opposite to the cutting edge; the catch corresponds to the notch.

In installing the blade, push the movable part backward towards the handle, lift the free end of the locking part, insert the blade, rotate the locking part downwards so that the catch falls into the notch, then push the moving part toward the blade so that it presses down the locking part to hold the blade into the place.

The installation of the blade is easy and fast. The structure of the knife is simple and sound. In addition, the knife head can be rotably folded towards the handle, which is hollow, so that the blade and the knife head can be stored inside the handle. This way, the volume of the knife is reduced for easy carrying.

DETAILED DESCRIPTION OF THE INVENTION

Figure 1:
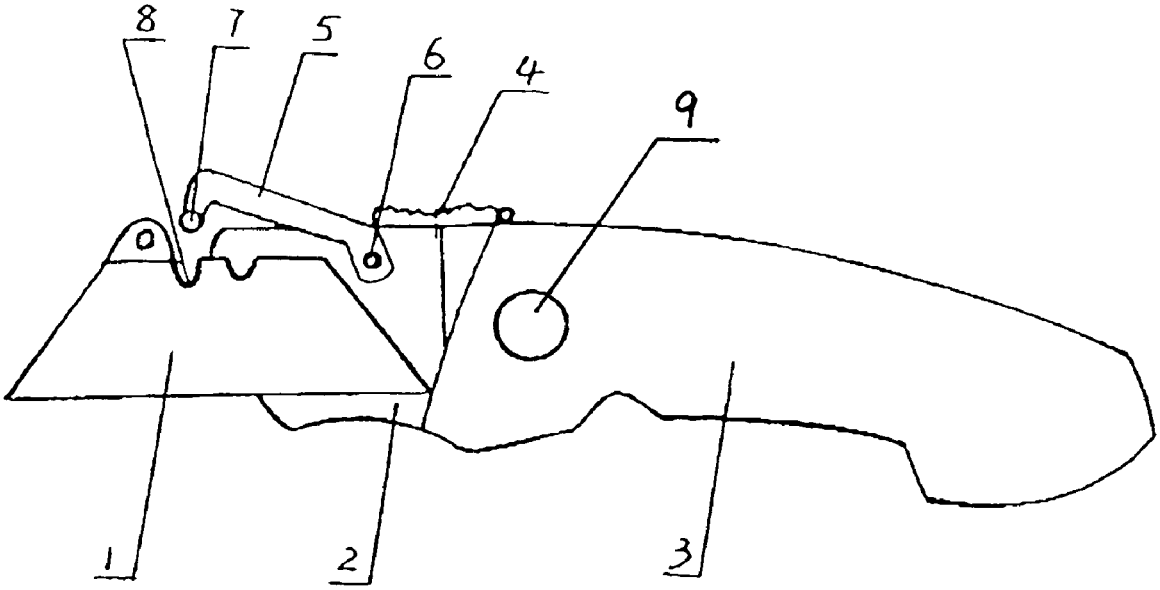
FIG. 1 is a schematic drawing of the present invention.

As shown in FIG. 1, the foldable knife of the invention comprises a blade 1, a knife head 2 and a handle 3, characterized in that: the knife head 2 has a movable part 4 which can be pushed to press on a locking part 5; the locking part 5 has two ends, one end is rotably fastened by a first bolt 6 to the knife head 2 and another, a free end, has a catch 7; the blade 1 has a notch 8 on the edge opposite to the cutting edge; the catch 7 corresponds to the notch 8.

The blade 1 may have two or more notches 8, for selecting different protruding lengths of the blade 1.

The knife head 2 is rotably fastened on the handle 3 by a second bolt 9. The handle 3 is hollow with an opening at one side. The knife head 2 and the blade 1 can be rotably folded toward the opening and at least partially into the handle 3, so that the blade 1 and the knife head 2 can be stored inside the handle 3. This way, the volume of the knife is reduced for easy carrying.

What is claimed is:

1. A foldable knife, comprising a blade (1), a knife head (2) for installing the blade (1) thereon and a handle (3) adjoining the knife head (2), characterized in that:

the knife head (2) has a movable part (4) and a locking part (5), the locking part (5) has two ends, one end is rotably fastened by a bolt (6) to the knife head (2) and another, a free end, has a catch (7), the blade (1) has a notch (8) on an edge opposite to a cutting edge, and the catch (7) corresponds to the notch (8), wherein the movable part (4) forces the catch (7) of the locking part (5) to engage with the notch (8) of the blade (1) so as to secure the blade (1) onto the knife head (2) when the movable part (4) is pushed away from the handle (3), and releases the locking part (5) so that the catch (7) and the notch (8) can be separated when the movable part (4) is pushed toward the handle (3);

wherein the movable part is at least partially extended over the locking part when the catch of the locking part is engaged with the notch of the blade.

2. The foldable knife of claim 1, characterized in that the blade (1) has two or more notches (8).

3. The foldable knife of claim 1, characterized in that the handle (3) comprises a recess and the knife head (2) is rotably fastened on the handle (3) by a bolt (9), the knife head (2) and the blade (1) can be rotably folded at least partially into the recess (3).

4. The foldable knife of claim 1, wherein the end of the locking part (5) that is rotably fastened to the knife head (2) is located nearer the handle (3) than the free end having the catch (7) when the blade (1) is securely installed on the knife head (2).

* * * * *